US005112181A

United States Patent [19]

Rasmussen

[11] Patent Number: 5,112,181

[45] Date of Patent: May 12, 1992

[54] FEEDING APPARATUS FOR TRANSFERRING EGGS

[75] Inventor: Hans Kristian L. Rasmussen, Morud, Denmark

[73] Assignee: Sanovo Engineering A/S, Odense NV, Denmark

[21] Appl. No.: 597,036

[22] Filed: Oct. 15, 1990

[30] Foreign Application Priority Data

Oct. 19, 1989 [DK] Denmark ..... 5189/89

[51] Int. Cl.[5] ..... B65G 47/90

[52] U.S. Cl. ..... 414/416; 294/2; 294/65; 294/87.12; 414/796.9

[58] Field of Search ..... 414/416, 422, 796.9, 414/797, 796.7; 198/468.6, 471.1; 294/2, 65, 64.1, 87.12

[56] References Cited

U.S. PATENT DOCUMENTS

| | | | |
|---|---|---|---|
| 2,253,283 | 8/1941 | Minaker | 414/416 |
| 2,415,997 | 2/1947 | Eldred | 198/470.1 X |
| 2,431,320 | 11/1947 | Fischer | 414/416 |
| 3,272,360 | 9/1966 | Van der Schoot | 414/416 |
| 3,306,646 | 2/1967 | Flora, Jr. | 294/2 |
| 3,716,147 | 2/1973 | Pipes | 414/416 X |
| 4,045,073 | 8/1977 | Mosterd | 294/87.12 |
| 4,293,272 | 10/1981 | Jellema | 414/416 X |
| 4,355,936 | 10/1982 | Thomas et al. | 414/796.9 X |
| 4,411,574 | 10/1983 | Riley | 414/416 X |
| 4,793,762 | 12/1988 | Münch et al. | 414/416 |

FOREIGN PATENT DOCUMENTS

| | | |
|---|---|---|
| 2649394 | 12/1977 | Fed. Rep. of Germany . |
| 2938688 | 4/1980 | Fed. Rep. of Germany . |
| 2261928 | 9/1975 | France . |

*Primary Examiner*—David A. Bucci

*Attorney, Agent, or Firm*—Wegner, Cantor, Mueller & Player

[57] ABSTRACT

A feeding apparatus for transferring eggs from a pile of egg trays to an egg depositing position on a supply conveyor of an egg processing machine comprises at least three units which each comprise lifting and retaining heads for lifting all eggs from an egg tray and transferring the eggs to the depositing position and releasable grapplers for transportng the egg trays. The units move in a closed path between a first operational position where a pole of egg trays is located, a second operational position where emptied egg trays are received and a third operational position where the egg depositing position is located. The units are vertically movable at each of these operational positions between an operational level and a conveyance level. The grappler releases retained egg trays at the second position of operation, whereas the units retain the eggs for transfer to the egg despositing position.

6 Claims, 2 Drawing Sheets

FEEDING APPARATUS FOR TRANSFERRING EGGS

BACKGROUND OF THE INVENTION

The invention relates to a feeding apparatus for transferring eggs from a pile of egg trays to an egg depositing position on a supply conveyor of an egg processing machine, comprising means for lifting the upper eggs containing tray from the pile and for lifting the eggs from said tray and moving the eggs to said egg depositing position and supplementary means for controlling the tray lifting operation in dependence on an orientation displaced 90° of every other egg tray of the pile.

In a current apparatus of this type piles of egg trays are fed on a first linear conveyor to a transfer position. A first egg lifting device comprising a sucker for each egg and grappler arms for the egg tray proper lifts the upper egg tray from the pile and conveys it through a circular path in a plane perpendicular to the direction of movement of the first conveyor to a second linear conveyor that is parallel to the first conveyor. A second egg lifting device comprising a sucker for each egg lifts the eggs from the tray and conveys them through a circular path in a plane perpendicular to the direction of movement of the conveyors to the supply conveyor of an egg processing machine, while the egg tray proper is left on the second conveyor to be conveyed thereon to a collecting station for empty egg trays The control of the tray lifting operation in dependence on the orientation displaced 90° of every other tray in the pile is effected by pivoting a lifting fork which in the transfer position lifts the pile of egg trays to the first egg lifting device in step with the trays being lifted from the pile which is thus becoming lower.

It is a disadvantage of the prior art apparatus that it makes use of two lifting devices, firstly because it is resource-demanding and, secondly, because each lifting of eggs involves the risk of cracking the eggs.

In an egg transfer device disclosed in published DE Patent Specification No. 26 49 394 for depiling egg trays fed on a first conveyor and transferring the egg trays to a second conveyor, use is made of a lifting device of the same type is the above described first egg lifting device. The lifting device of said reference is suspended in an arm pivotal about a vertical axis. The arm may further be raised or lowered above the conveyors. Every other lifted tray is pivoted 90° in order to obtain a uniform orientation of the trays on the second conveyor.

The application of said apparatus likewise requires the use of a supplementary lifting device for lifting the eggs from the trays.

SUMMARY OF THE INVENTION

It is the object of the invention to provide a feeding device for the transfer of eggs in which the above drawbacks have been eliminated.

This is obtained by an apparatus which is characterized in that at least three egg listing and retaining units each with individual lifting and retaining means for all the eggs in an egg tray and releasable grappler means for the egg tray are moved in a closed path between first, second and third operational positions. The first operational position is located at the pile of trays, the second operational position is located at a receiver unit for emptied egg trays and the third operational position is where eggs are deposited. The units are movable at each of these positions of operation between an operational level and an upper conveyance level. There are provided means for releasing egg trays retained by the grappler means at the second operational position whereas the units retain the eggs for transfer to the egg depositing position.

By the apparatus according to the invention a tray with eggs may be lifted from a pile of trays and transferred to a position in which the tray is being deposited while the eggs are being retained by the individual egg lifting and holding means, following which the tray is caught and the eggs are fed onwards to the supply conveyor of an egg processing machine, i.e. the eggs are only lifted once during this operation instead of twice, and a single egg lifting and holder unit effects the whole transfer contrary to the previous two units.

BRIEF DESCRIPTION OF THE DRAWINGS

The invention will now be explained in detail by examples with reference to the schematical drawings, in which.

DESCRIPTION OF THE PREFERRED EMBODIMENTS

Figure 1:
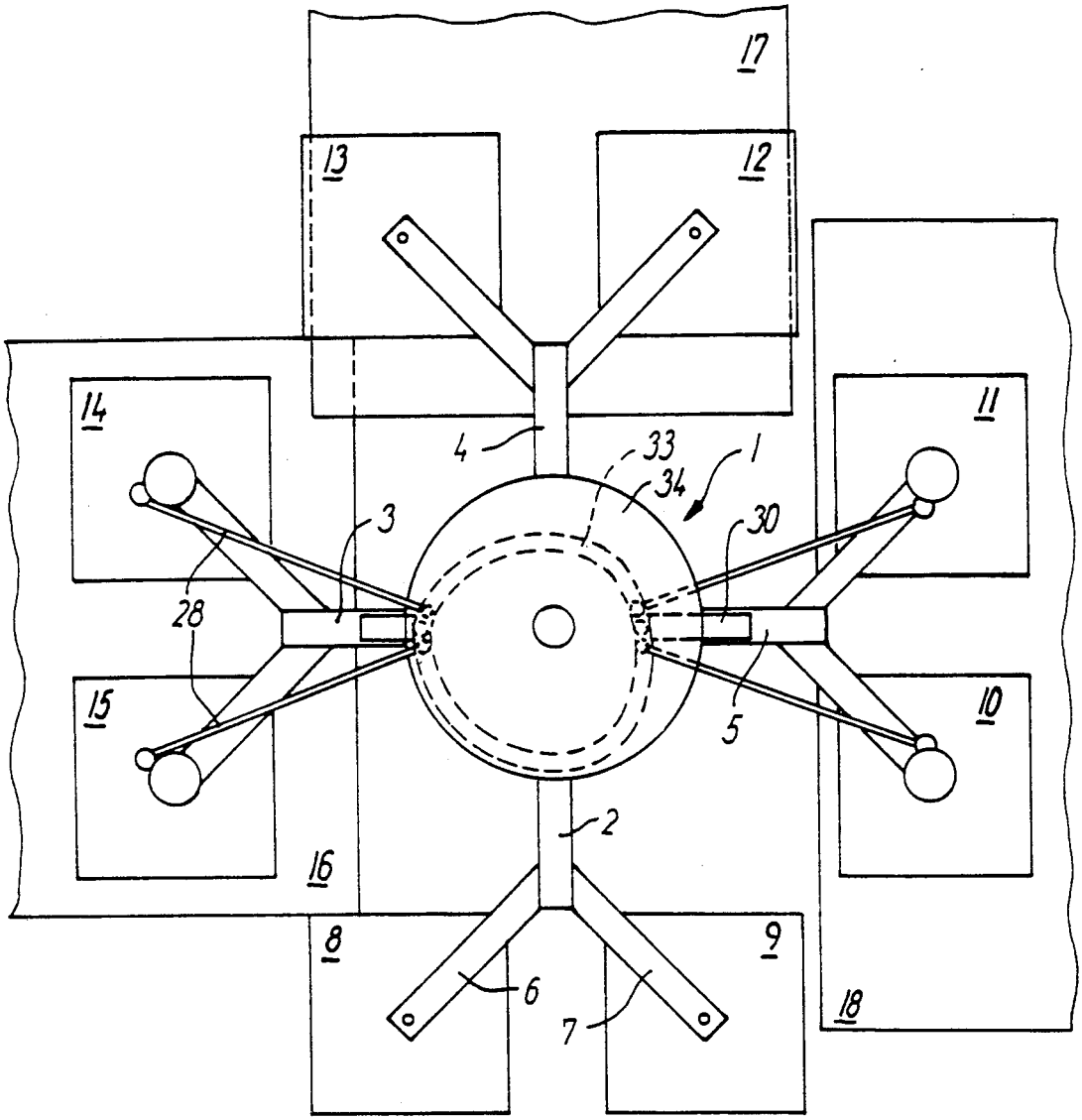
FIG. 1 is a feeding apparatus viewed from above.

In the illustrated embodiment the feeding apparatus consists of a roundabout with four arms 2, 3, 4 and in 5 perpendicular to each other and which individual bifurcations 6, 7 carry two egg lifting and retaining units, referred to hereinafter as lifting heads 8 to 15. Three conveyors are positioned around roundabout 1, namely, a tray pile conveyor 16 for conveying piles of filled egg trays, a tray conveyor 17 for the conveyance of empty egg trays and a supply conveyor 18 for an egg processing machine, not shown. In connection with the tray pile conveyor 16 there are arranged lifting forks 19 below lifting heads 14 and 15 for raising the piles of trays disposed thereon, as explained later on. Moreover, conveyors 16 to 18 as well as lifting forks 19 and lifting heads 8 to 15 are of a tape known per se.

All of the lifting heads 8 to 15 have a frame 20 in which suckers 21 are suspended, one for each egg in an egg tray, for instance thirty pieces, and two grappler arms 22 hinged to two parallel sides of the frame. Suckers 21 are connected alternately and in dependence on the position of the roundabout arm 2 to 5 with which they are associated, With a compressed-air and vacuum source. The grappler arms may pivot inwards and outwards about their hinges into catching and releasing positions, the actual position being chosen by means of a toggle switch 23 on the underside of the respective roundabout arm. Toggle switches 23 are changed over, as explained later on, by stanchions 24, **24*a* positioned on a stationary frame member 25. In the illustrated embodiment the movements of the grappler arms are driven pneumatically, but activation means and conduits for compressed-air and vacuum for suckers 21** are not illustrated in the drawings.

Lifting heads 8 to 15 are mounted on a respective vertical supporting rod 26. Said supporting rods are inserted into and suspended in guide tubes 27 so as to be pushed upwards into said tubes from the bottom positions.

Regarding lifting heads 10, 11 and 14, 15, guide tubes 27 may be pivoted about their respective axes by means of guide rods 28 which at their end are hinged to an arm 20 on a respective one guide tube 27 and at their other end are hinged to a slide member 30 of a guide 31 on the respective roundabout arm 3, 5. Slide members SO can move on their respective guides 81 in parallel to roundabout arms 3, 5, their movements being controlled through pins 32 by a guide groove 33 in a cam disc 34. Cam disc 34 is through a frame portion secured against rotation.

Lifting heads 9, 12 and 13 are not, contrary to those mentioned above, able to rotate about the axes of their supporting rods.

The whole roundabout 1 may be rotated and lowered/raised alternately by means of known mechanisms, e.g. a "Maltese cross" and a cam disc.

Figure 2:
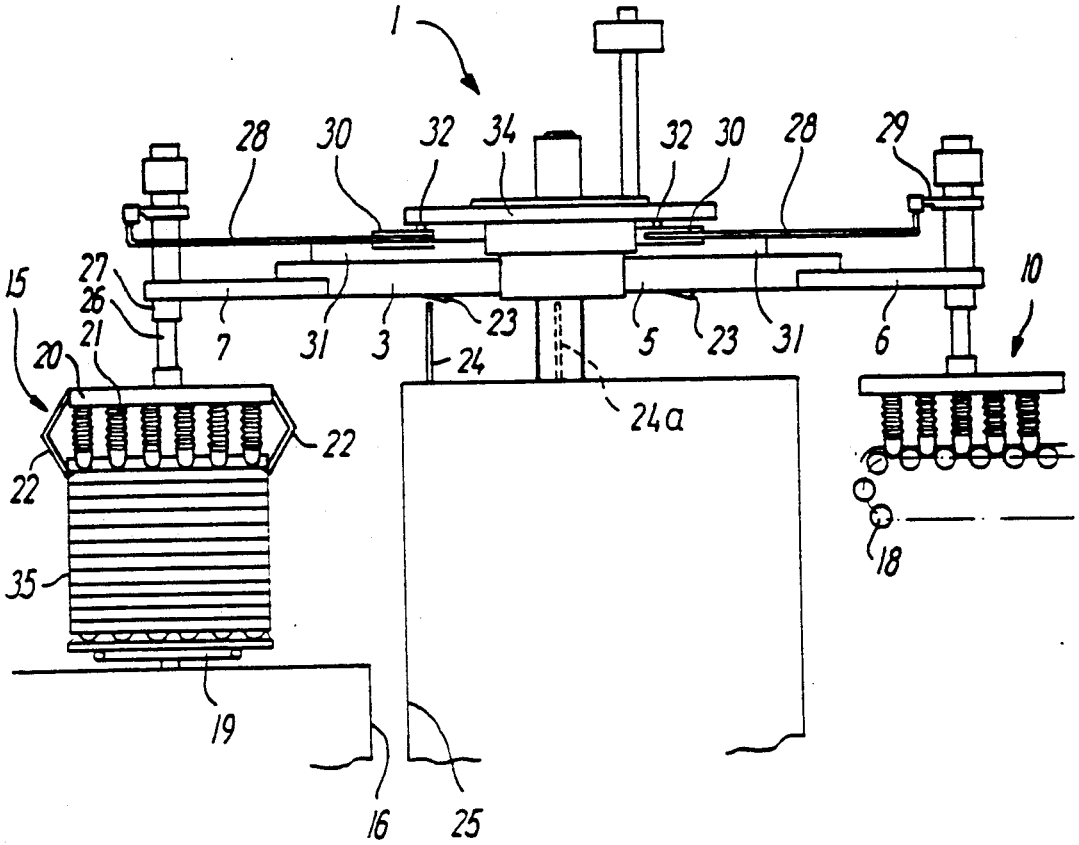
FIG. 2 is the feeding apparatus laterally viewed, a set of egg lifting and holding means being removed for the sake of clearness.

When roundabout 1 is not rotated, i.e. while it is being lowered or raised, three of the four pairs of lifting heads 10, 11; 12, 13; 14, 15 are located above a respective one of conveyors 16 to 18 in a position of operation The feeding apparatus operates as follows:

A pile of egg trays 35 is positioned as shown in FIG. 2 at the first position of operation on lifting fork 19 lifting fork 19 raises pile 35 stepwise so that the upper egg tray is disposed on a predetermined lifting level. Roundabout 1, which is in the angular position illustrated in the drawing, is lowered, thereby also lowering lifting head 15 until suckers 21 touch the eggs in the egg tray. At this time grappler arms 22 on lifting head 15 are in their release position and suckers 21 are connected with the compressed-air source. Roundabout 15 further lowered a little, thereby causing lifting head 15 to rest on the eggs and possibly be raised a little in relation to roundabout 1, in that supporting rod 26 of lifting head 15 slides up into tube 27. The lifting head is thus prevented from resting too heavily on the eggs and any deviation in the lifting level due to irregularities of the effective contribution of the individual egg trays to the height of the pile is compensated for.

The final lowering of roundabout 1 makes toggle switch 23 touch stanchion 24, thereby changing over the switch and causing grappler arms 22 to clutch the egg tray. At this time, the eggs are sucked firmly to their respective sucker 22, which are now connected with the vacuum source. It should be observed that even though the lowering is described stepwise, the movement is effected continuously.

Roundabout is now lifted to a conveyance level and rotated 90° clockwise, as illustrated in FIG. 1 Lifting head 15 and lifting head 14 that operate in parallel therewith are now positioned in the second position of operation above tray conveyor 17.

Upon rotating from the first position of operation to the second position of operation lifting heads 14 and 15 are rotated 90°. about the axes of their supporting rods 26, controlled via guide rods 28, slide member 30 and pin 32 by guide groove 33 in cam disc 34.

Roundabout is lowered again, and by the final lowering, toggle switch 23 is made to touch a second stanchion 24*a* corresponding to stanchion 24 at the first position of operation, thereby causing the switch to change over again so that grappler arms 22 turn outwards to release the egg trays, the eggs being still retained by suckers 22.

Upon release, the egg trays from the two lifting heads operating in parallel fall down on conveyor 17 conveying the egg trays to a collecting station of a known type, possibly after detection and separation of trays not emptied Roundabout 1 is again raised, rotated 90° and lowered, thereby moving the set of lifting heads 14, 15 to the third position of operation above supply conveyor 18 Lifting heads 14 and 15 thereby occupy the positions which in the drawing are occupied by lifting heads 10 and 11.

Suckers 22 are now connected with the compressed-air source instead of the vacuum source. This ensures a precise depositing of the eggs on supply conveyor 18. This supply conveyor may in a known manner be constituted by "hourglass"-shaped rollers, thereby providing a depression for each egg. It should be observed that the one grappler arm 22 on lifting head 10 in FIG. 2 would protrude from the plane of the figure but for the sake of clearness it has not been shown.

Roundabout is again raised, rotated 90° and lowered. The pair of lifting heads 14, 15 will thus come to an "empty" fourth position of operation. Due to the fact that the suckers are still connected with the compressed-air source they will be blown clean of dirt, of shells of unintentionally cracked eggs and the like.

During the rotation of the roundabout from the third to the fourth position of operation lifting heads 14 and 15 are rotated 90° about the axes of their supporting rods 26 in the opposite direction compared to the rotation effected between the first and the second position of operation.

The roundabout is raised, rotated 90° and lowered, following which it is back in the position shown in FIG. 2.

Apart from the fact that the pairs of lifting heads 8, 9 and 12, 13 cannot rotate about the axes of their rods 26, as mentioned, the remaining pairs of lifting heads 8, 9; 10, 11 and 12, 13 pass through the same cycle as described for the pair of lifting heads 14, 15, but with a phase delay of 90°, 18O° and 270°, respectively.

It should be observed that while every other tray of the tray piles on the tray pile conveyor 16 is rotated 90° the trays have, by virtue of the above mentioned 90°-rotation of lifting heads 10, 11 and 14, 15, on every other roundabout arm 3, 5 the same orientation when arriving at tray conveyor 17.

The above described embodiment of the invention may, be modified in various ways. The roundabout may for example, be provided with only three arms. In this case all of the lifting heads may be rotatable through 90° about their vertical center axes and precautions must be taken that the each lifting head is rotated only in every other of its cycles. Moreover, the fourth "empty" position of operation will be cancelled and the three conveyors uniformly distributed around the roundabout.

It will be recognized that it is also possible to make use of a larger number of roundabout arms than four. Likewise, each roundabout arm may be provided with a number of lifting heads other than two. It is finally emphasized that the lowering/raising movement does not need to be effected as a united movement for the whole roundabout but it may be imparted to the individual roundabout arm or to the individual lifting head.

I claim:

1. An apparatus for transferring eggs from a pile of egg trays to an egg depositing position on means for conveying eggs to an egg processing machine, said apparatus comprising:

(a) at least three egg and egg tray transfer units, each of said units comprising:

(i) means for lifting each individual egg from an egg tray and retaining the eggs until the eggs are transferred to said egg depositing position on the means for conveying eggs, and (ii) grappler means for releasably retaining an egg tray;

(b) means for moving said transfer units between a first position of operation, a second position of operation and a third position of operation along a closed path and for vertically lowering and raising said units between an operational level and an upper conveyance level when said units are located at each of said first, second and third positions of operation, wherein said first position of operation is located in the vicinity of means for supplying piles of egg trays containing eggs, said second position of operation is located in the vicinity of means for removing emptied egg trays and said third position of operation is located in the vicinity of said egg depositing position;

(c) means for effecting release of an egg tray retained by said grappler means of said transfer units when said transfer units are positioned at said second operational position; and (d) control means for controlling orientations of said transfer units such that said transfer units are oriented to transfer eggs and egg trays from a pile of egg trays at said first operational position having its egg trays arranged 90° in relation to an adjacent egg tray in said pile.

2. The apparatus as claimed in claim 1, wherein said transfer units are suspended from corresponding substantially horizontal arms attached to a support rotatable about a vertical axis, and wherein said transfer units are connected to said arms such that said transfer units are vertically movable in relation to said arms.

3. The apparatus as claimed in claim 2, wherein said arms are movable in unison between said operational level and said upper conveyance level.

4. The apparatus as claimed in claim 2, wherein at least one of said transfer units is rotatably connected to a vertical support rod of its corresponding arm.

5. The apparatus as claimed in claim 4, wherein said control means comprises means for effecting a 90° rotation of alternating transfer units at a position along said closed path before said first operational position and a 90° rotation of said alternating transfer units in a direction opposite to said first direction at a position along said closed path after said first operational position.

6. The apparatus as claimed in claim 5, comprising four transfer units wherein two nonadjacent transfer units are rotatable about a vertical connecting rod, and a fourth operational position located along said closed path between said third and first operational positions, said rotation means effecting rotation in said first direction between said third and fourth operational positions and in said opposite direction between said first and second operational positions.

* * * * *